US006528713B2

(12) United States Patent
Maehara

(10) Patent No.: US 6,528,713 B2
(45) Date of Patent: Mar. 4, 2003

(54) KEYBOARD MUSICAL INSTRUMENT HAVING HEIGHT CONTROLLABLE PEDALS

(75) Inventor: Kazuo Maehara, Shizuoka-ken (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/081,688

(22) Filed: Feb. 20, 2002

(65) Prior Publication Data

US 2002/0112594 A1 Aug. 22, 2002

(30) Foreign Application Priority Data

Feb. 21, 2001 (JP) ..... 2001-045557

(51) Int. Cl.[7] ..... G10C 3/12
(52) U.S. Cl. ..... 84/426; 84/225
(58) Field of Search ..... 84/177, 217, 218, 84/225, 226, 227, 228, 230, 231, 232, 426

(56) References Cited

U.S. PATENT DOCUMENTS 3,365,994 A * 1/1968 Rutherford et al. ..... 84/228
4,041,829 A * 8/1977 Robeson et al. ..... 84/225
5,565,635 A * 10/1996 Kaneko et al. ..... 84/20
5,905,220 A * 5/1999 Lee et al. ..... 84/461
5,936,172 A * 8/1999 de La Rochefordiere ..... 84/217
6,448,481 B2 * 9/2002 Machara et al. ..... 84/225

FOREIGN PATENT DOCUMENTS

JP 59-158190 10/1984
JP 09-044145 2/1997

* cited by examiner

*Primary Examiner*—Kim Lockett
(74) *Attorney, Agent, or Firm*—Morrison & Foerster LLP

(57) ABSTRACT

A grand piano includes a pedal mechanism constituted by a lyre block attached to the lower surface of a piano case, pedal posts hung from the lyre block, a lyre box engaged with the pedal posts, pedals rotatably supported by the lyre box and pedal rods connected between the pedals and damper mechanism/keyboard accommodated in the piano case, wherein the lyre box is movable along the pedal posts, and a coupler is provided between the lyre box and the pedal posts so as to maintain the pedals at a position suitable for a pianist, whereby the pianist can adjust the pedals to the suitable position before fingering on the keyboard.

19 Claims, 9 Drawing Sheets

KEYBOARD MUSICAL INSTRUMENT HAVING HEIGHT CONTROLLABLE PEDALS

FIELD OF THE INVENTION

This invention relates to a keyboard musical instrument and, more particularly, to a keyboard musical such as acoustic pianos and composite keyboard musical instruments fabricated on the basis of the acoustic pianos.

DESCRIPTION OF THE RELATED ART

FIG. 1 shows a typical example of the acoustic piano. The acoustic piano is classified in the grand piano. The prior art grand piano includes a piano case 1, legs 2 and a pedal system 3. Although a keyboard, action mechanism, hammers, dampers and strings are installed inside the piano case, these component parts are not seen in the figure. The legs 2 downwardly project from the piano case 1, and maintain the piano case and, accordingly, component parts over the floor.

The pedal system 3 is associated with the dampers and the keyboard. When a pianist actuates the pedal system 3, the pedal system 3 keeps a damper or dampers spaced from the strings, and makes the keyboard and, accordingly, the hammers slightly offset from the associated sets of strings. As a result, the tone or tones are prolonged or lessened. Thus, the pianist changes the loudness of tones and the length of tones by using the pedal system 3.

The pedal system 3 includes a lyre box 4, pedals 5A/5B/5C, pedal rods 6 and pedal posts 7. Although a lyre block is fixed to the lower surface of the key bed, which defines the bottom of the piano case 1, the lyre block is not seen in the figure. The lyre box 4 and pedal posts 7 are formed of wood. The pedal posts 7 are fixed to the lyre block, and downwardly project from the lyre block. The lyre box 4 is fixed to the lower ends of the pedal posts 7, and are hung from the piano case 1. The pedal posts 7 are so rigid that users can not change the distance between the lyre block and the lyre box 4.

The pedals 5A, 5B and 5C are called as "damper pedal", "sostenuto pedal" and "soft pedal", respectively. Tough not shown in the figure, the pedals 5A/5B/5C are turnably supported inside the lyre box 4, and projects through holes formed in the front panel of the lyre box 4. The pedal rods 6 are connected at the lower ends thereof to the rear portions of the pedals 5A/5B/5C and at the upper ends thereof to the dampers and the keyboard.

A chair is put on the floor in front of the piano case 1, and a pianist sits on the chair for fingering on the keyboard. While the pianist is fingering a piece of music on the keyboard, he or she steps on the pedals 5A/5B/5C at appropriate timing so as to prolong and/or lessen the tones. The pedals 5A/5B/5C are depressed by his or her right foot and left foot. For this reason, the distance between the lyre block and the lyre box is adjusted to a certain distance longer than the shank of a standard adult.

A problem is encountered in the prior art grand piano in that the distance between the lyre block and the lyre box is too long for children. The chair is usually regulable in height between the floor and the cushion. When a child practices fingering, the cushion may be lowered. Then, the child can step on the pedals 5A/5B/5C. However, the keyboard becomes too high for the child. A pedal system is also incorporated in an upright piano, and the pedals are adjusted to adult players. Thus, the prior art acoustic pianos are designed to be played by adults, and children are not taken into account.

A solution has been proposed. The solution is disclosed in Japanese Utility Model application laid-open 59-158190 and Japanese Patent Application laid-open No. 9-44145. Assistant pedal systems are disclosed therein. The assistant pedal system is attached to the pedals 5A/5B/5C. The child steps on the assistant pedal system, and the assistant pedal system replays the foot action to the pedals 5A/5B/5C. Thus, the assistant pedal system permits the child to play the grand piano designed for adults.

However, various problems are encountered in the assistant pedal systems. First, the assistant pedal systems have complicated structures, and, accordingly, are expensive. The prior art assistant pedal systems are to be regulable in the distance between the pedals 5A/5B/5C and the assistant pedals, because the children have their own shanks different in length. If the distance between the pedals 5A/5B/5C and the assistant pedals was not regulable, the prior art assistant pedal system would merely take up the different between the shank of the standard adult and the shank of a standard child. In order to permit users to regulate the distance between the pedals 5A/5B/5C and the assistant pedals, the prior art assistant pedal systems have regulating mechanisms, and the regulating mechanisms make the prior art assistant pedal systems complicated and expensive.

Another problem is that malfunction is liable to take place. While a child is playing a piece of music on the keyboard, the prior art assistant pedal system is expected to keep the linkage between the pedals 5A/5B/5C and the assistant pedals stable. On the other hand, it is appreciated for the users to attach the prior art assistant pedal mechanism to and detach it from the pedals 5A/5B/5C easily. If a simple coupler is used in the prior art assistant pedal system, the prior art assistant pedal system is liable to be disengaged from the pedals 5A/5B/5C, and the child discontinues the practice, and attaches the prior art assistant pedal system to the pedals 5A/5B/5C, again. Meanwhile, if the prior art assistant pedal system is strongly attached to the pedals 5A/5B/5C, the complicated assembling and disassembling works would wear his or her temper to threads.

Yet another problem is that the prior art assistant pedal system damages the external appearance of the acoustic piano. Users may like electronic keyboard with modern appearance. However, the users expect the acoustic pianos to have the classical features. When the prior art assistant pedal system is attached to the pedal system 3 of the acoustic piano, the external appearance is curious, and is far from the classical feature.

SUMMARY OF THE INVENTION

It is therefore an important object of the present invention to provide a keyboard musical instrument, which is appreciated by both adults and children without any damage to the external appearance.

In accordance with one aspect of the present invention, there is provided a keyboard musical instrument comprising a case having an inner space, a keyboard mounted on a flat board of the case and exposed to a player, an internal mechanism including an action mechanism linked with the keyboard and actuated when the player depresses keys of the keyboard, hammers associated with the keys, respectively, and driven for rotation by the action mechanism when the player depresses the associated keys, beaten members provided in association with the hammers and struck with the hammers at the end of the rotation and a damper mechanism linked with the keyboard and driven by the keys so as to influence vibrations of the beaten members, and a pedal mechanism including plural pedals depressed by the player for changing attributes of tones to be generated when the keys are depressed, a foundation on which the plural pedals are rotatably supported, plural connectors connected between the plural pedals and the internal mechanism for transmitting motion of the pedals to the internal mechanism, a mechanism provided between the case and the foundation and permit the foundation to move with respect to the case and a coupler provided for the foundation and changed between a releasing position for permitting the foundation to move with respect to the case and a fixing position for prohibiting the foundation from changing the position thereof with respect to the case.

BRIEF DESCRIPTION OF THE DRAWINGS

The features and advantages of the keyboard musical instrument will be more clearly understood from the following description taken in conjunction with the accompanying drawings in which.

DESCRIPTION OF THE PREFERRED EMBODIMENTS

First Embodiment

Figure 2:
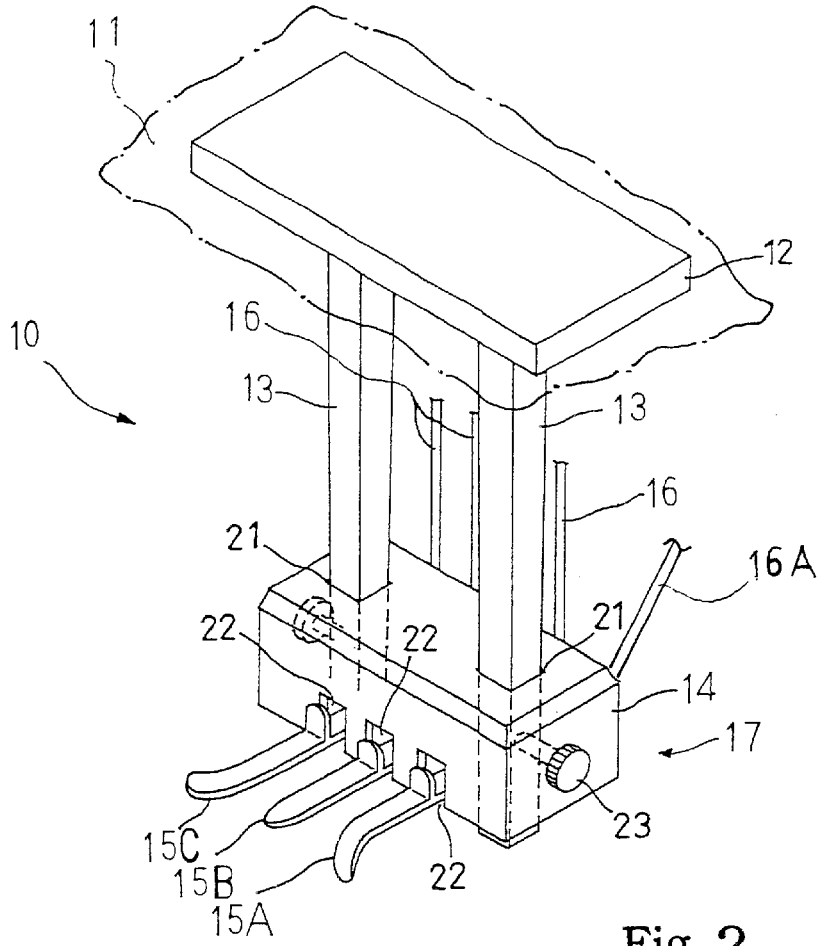
FIG. 2 is a perspective view showing the structure of a pedal system incorporated in a grand piano according to the present invention.

Referring to FIG. 2 of the drawings, a pedal system 10 is hung from a key bed 11. The key bed 11 forms a part of a piano case, which in turn forms a grand piano together with legs, keyboard, action mechanism, hammers, dampers and strings. The piano case, keyboard, action mechanism, hammers, dampers and strings are similar to those of the standard grand piano, and no further description is hereinbelow incorporated for the sake of simplicity.

The pedal system 10 includes a lyre block 12, pedal posts 13, a lyre box 14, pedals 15A/15B/15C, pedal rods 16, a lyre brace 16A and a coupler 17. The coupler 17 is newly added to the pedal system 10, and is provided between the lyre box 14 and the pedal posts 13 for adjusting the lyre box 14 to a position spaced from the lyre block 12 by a distance appropriate to a pianist either adult or child. The lyre box 14 is slidable along the pedal posts 13. The pianist moves the lyre box 14 to a suitable position, and secures the lyre box 14 to the pedal posts 13. The lyre block 12, the pedal posts 13, the lyre box 14, the pedals 15A/15B/15C and the pedal rods 16 are similar in external appearance to those of the standard grand piano, and the coupler 17 is much smaller than the lyre box 14. The coupler 17 is not conspicuous so that the users feel the pedal system familiar.

The pedals 15A/15B/15C are called as "damper pedal", "sostenuto pedal" and "soft pedal". The damper pedal 15A and sostenuto pedal 15B are associated with the dampers, and the soft pedal 15C makes the keyboard and hammers offset from the associated strings. The damper pedal 15A is used for prolonging the tones, and the sostenuto pedal 15B makes the tone prolonged independently of others. The soft pedal 15C is used for lessening the loudness of the tones.

The lyre block 12 is fixed to the lower surface of the key bed 11, and the pedal posts 13 are fixed to the lyre block 12. The pedal posits 13 downwardly project from the lyre block 12 in parallel to each other. The pedal posts 13 are formed of wood, and have a certain length. The length is not variable.

The lyre brace 16A is connected at the upper end thereof to a key bed, which forms a part of the piano case, and at the other end thereof to the lyre box 14. Thus, the lyre brace 16A obliquely extends between the piano case and the lyre box 14, and makes the lyre box 14 to endure against the large force exerted on the pedals 15A/15B/15C.

Figure 3:
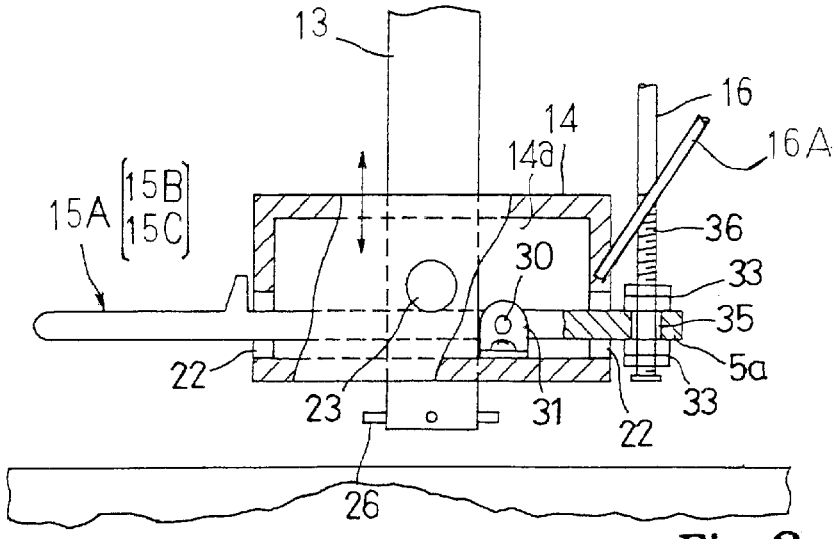
FIG. 3 is a cross sectional view showing the linkage between a pedal and a pedal rod inside a lyre box.
Figure 4:
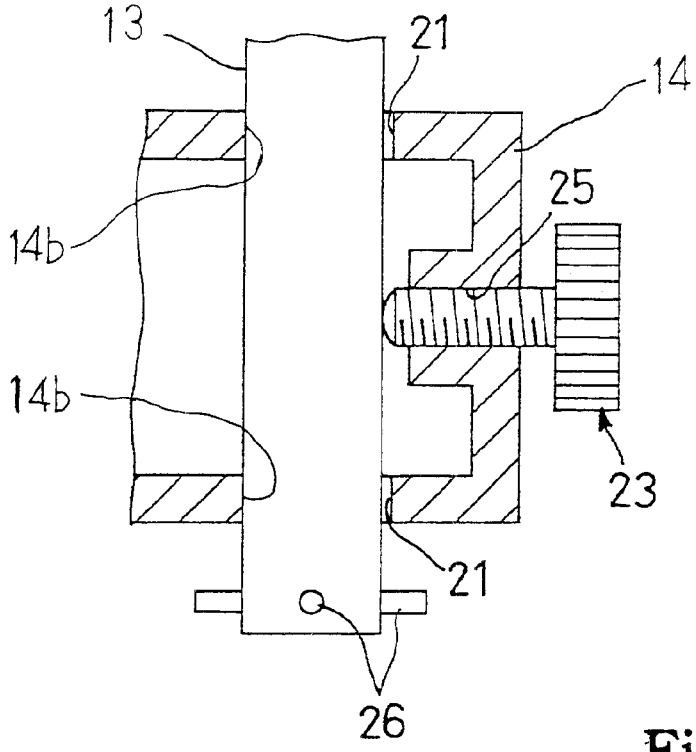
FIG. 4 is a cross sectional view showing a lyre box slidable on pedal posts.

The lyre box 14 has a generally rectangular parallelepiped configuration, and is constituted by upper/lower panels, a pair of side panels and front/rear panels. These panels define an inner space 14*a* in the lyre box 14 as shown in FIG. 3. A pair of through-holes 21 is formed in the upper panel, and the through-holes 21 are spaced from each other by a distance equal to the distance between the pedal posts 13. Similarly, a pair of through-holes 21 is formed in the lower panels, and the through-holes 21 are respectively aligned with the through-holes 21 formed in the upper panel as shown in FIG. 4. The through-holes 21 are similar in plane configuration to the pedal posts 13, and are slightly wider than the cross sections of the pedal posts 13. For this reason, the pedal posts 13 pass through the inner space 14*a,* and projects from the lower panel of the lyre box 14. Stopper pins 26 are inserted into the lower portions of the pedal posts 13, and do not permit the lower portions of the pedal posts 13 to pass through the through-holes 21 formed in the lower panel.

Three through-holes 22 are formed in the front panel of the lyre box 14, and corresponding through-holes 22 are further formed in the rear panel. The three through-holes 22 in the front panel are aligned with the three through-holes 22 in the rear panel. Thus, three pairs of through-holes 22 are open to the outside. The three pairs of through-holes 22 are respectively assigned to the three pedals 15A/15B/15C. Three brackets 31 are fixed to the inner surface of the lower panel of the lyre box 14, and are provided on virtual lines passing through the three pairs of through-holes 22, respectively. Three pins 30 are fixed to the pedals 15A/15B/15C, and each pin 30 projects from both side surfaces of the associated pedal 15A/15B/15C. The pins 30 have respective centerlines, which are substantially perpendicular to the longitudinal directions of the associated pedals 15A/15B/15C. The pins 30 are rotatably supported by the brackets 31, respectively, and the pedals 15A/15B/15C project from the front and rear panels of the lyre box 14 through the three pairs of through-holes 22. The three pairs of through-holes 22 are wider than the thickness of the pedals 15A/15B/15C so that the pedals 15A/15B/15C are rotatable about the centerlines of the pins 30. Though not shown in the drawings, compression coil springs are inserted between the front portions of the pedals 15A/15B/15C and the lower panel of the lyre box 14. The compression coil springs urges the front portions of the pedals 15A/15B/15C upwardly at all times. Recesses are formed in the rear panel, and the lyre brace 16A is inserted into the recesses as shown in FIG. 3. The lyre brace 16A is telescopic and fixative at an arbitrary length so that the user can change the lyre box 14 from one position to another.

The pedal rods 16 are respectively connected to the rear portions of the pedals 15A/15B/15C. The rightmost pedal rod 16 and the center pedal rod 16 are connected between the damper/sostenuto pedals 15A/15B and the dampers, and the leftmost pedal rod 16 is connected between the soft pedal 15C and the keyboard. The pedal rods 16 vertically extend from the rear portions 5 of the pedals 15A/15B/15C. When a pianist steps on the pedal 15A/15B/15C, the front portion of the pedal 15A/15B/15C is sunk against the elastic force of the compression coil spring, and the rear portion pushes the pedal rod 16 upwardly. Thus, the pedal motion is relayed through the associated pedal rod 16 to the dampers or keyboard so as to actuate the components of the dampers or the keyboard. When the pianist removes the force from the pedal 15A/15B/15C, the compression coil spring causes the pedal 15A/15B/15C to return to the rest position.

Figure 5:
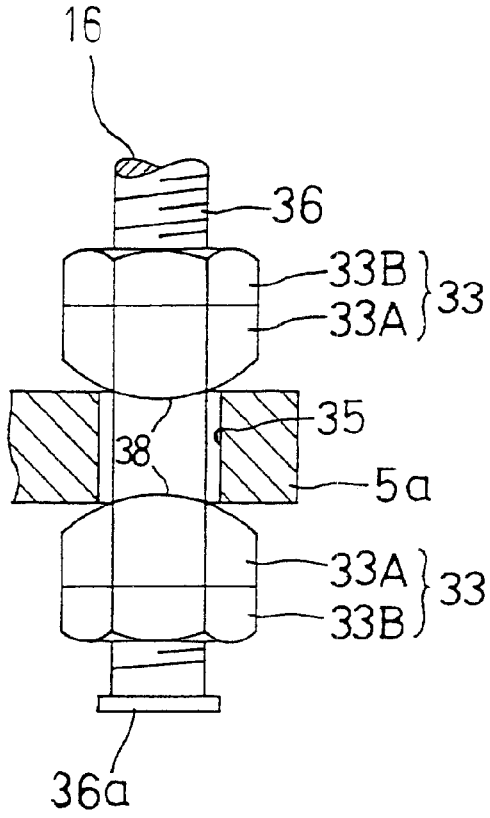
FIG. 5 is a cross sectional view showing a pedal connected to a pedal rod.

The connecting locations between the pedals **15A/15B/15*c* and the pedal rods 16 are changeable. Through-holes 35 are formed in the rear portions 5*a* of the pedals 15A/15B/15C, and are thicker than the pedal rods 16. The pedal rods 16 are loosely insertable into the through-holes 35 (see FIG. 5). This feature is desirable for the connection between the pedals 15A/15B/15C and the pedal rods 16, because the through-holes 35 allow the pedals 15A/15B/15C to incline with respect to the pedal rods 16. Male screws 36 are formed in the lower portions of the pedal rods 16. The threaded portions are long enough to permit the user to change the location of the lyre box 14. Three pairs of nuts 33 are engaged with the threaded portions of the pedal rods 16, and are movable along the threaded portions. One of the nuts 33 of each pair is over the rear portion of the associated pedal 15A/15B/15*c*, and the other nut 33 is under the rear portion. Each of the nuts 33 has a head portion 33A and a bottom portion 33B. The head portion 33A has a round surface 38 like a part of a spherical surface. The nut 33 over the rear portion 5*a* has the round surface 38 downwardly directed, and the other nut 33 under the rear portion 5*a* has the round surface 38 upwardly directed. Thus, the round surfaces are opposed to each other. The rear portion 5*a* of each pedal is sandwiched between the round surfaces 38 of the nuts 33. The round surfaces 38 are pressed to the upper and lower surfaces of the rear portion 5*a* of the associated pedal 15A/15B/15C, and are held in contact with the peripheries of the through-holes 35. The nuts 33 prohibit the rear portions 5*a* from chattering. The round surfaces 38 allow the rear portions 5*a* smoothly to incline. Stop rings 36*a* are engaged with the lower ends of the pedal rods 16, and do not permit the lower nuts 33** from undesirably dropping from the threaded portions.

Turning back to FIG. 4, threaded holes 25 are formed in the side panels of the lyre box 14, and have respective centerlines, which are perpendicular to the pedal posts 13. The lyre box 14 is secured to the pedal posts 13 by means of bolts 23. The bolts 23 have respective threaded stems, and the threaded stems project from knobs, respectively. The user grasps the knobs, and aligns the threaded stems with the threaded holes 25. The user turns the knobs. Then, the threaded stems are screwed into the threaded holes 25, and are brought into contact with the pedal posts 13. The user further turns the knobs. The threaded stems are pressed against the pedal posts 13, and urge the pedal posts 13 toward the inner surfaces **14*b* of the lyre box 14 defining the through-holes 21. The pedal posts 13 are strongly pressed against the inner surfaces 14*b*, and the lyre box 14 is secured to the pedal posts 13. Two pairs of pins 26 pass through the lower end portions of the pedal posts 13, respectively, and the pins 26 have a length greater than the inner distance of the associated through-holes 21. Even when the user moves the lyre box 14 downwardly, the lyre box 14 is brought into contact with the pins 26. Thus, the pins 26 set the lower limit to the lyre box 14, and present the lyre box 14 from dropping down from the pedal posts 13**.

Assuming now that the pianist is changed from an adult person to a child, the child or parent changes the lyre box 14 from the current position to a suitable position as follows. First, he or she loosens the nuts 33. The nuts 33 are spaced from the rear portions **5*a*, and make the pedals movable. He or she grasps the knob, and loosens the bolt 23. The other bolt 23 is also loosened. The lyre box 14 may fall down. Even so, the lyre box 14 stops at the pins 26. He or she lifts the lyre box 14. The lyre box 14 slides along the pedal posts 13, and the pedals 15A/15B/15*c* also slide along the pedal rods 16. The child or parent looks for suitable positions, and regulates the pedals 15A/15B/15C to the positions suitable to the child. When he or she finds the pedals 15A/15B/15C to be at the suitable positions, he or she turns the bolts 23 in the opposite direction, and presses the pedal posts 13 to the inner surfaces 14*b* of the lyre box 14. Thus, the lyre box 14 is secured to the pedal posts 13, and the pedals 15A/15B/15C are maintained at the suitable positions. Finally, he or she turns the nuts 33, and sandwiches the rear portions 5*a* of the pedals 15A/15B/15C between the round surfaces 38**.

As will be understood from the foregoing description, the grand piano according to the present invention permits the user to change the lyre box 14 to any position on the pedal posts 13 so as to adjust the pedals 15A/15B/15C to suitable positions by means of the coupler 17. Even if the pianist is changed to a child, the pedals 15A/15B/15C are located at the positions suitable to the child. While the pianist is fingering a piece of music on the grand piano, he or she exactly gives his or her own expression to the piece of music through the pedal system 10. Any assistant pedal system is not required for the grand piano, and the coupler 17 is not conspicuous. The manufacturer keeps the grand piano according to the present invention in the classical external appearance, and the grand piano according to the present invention will be favorably received by the users.

In the first embodiment, the bolts 23 and threaded holes 25 as a whole constitute the coupler 17. The lyre box 14 serves as a foundation, and the pedal rods 16 are corresponding to plural connectors. The pedal posts 13 and the upper/lower panels formed with the through-holes 21 as a whole constitute a mechanism.

Second Embodiment

Figure 6:
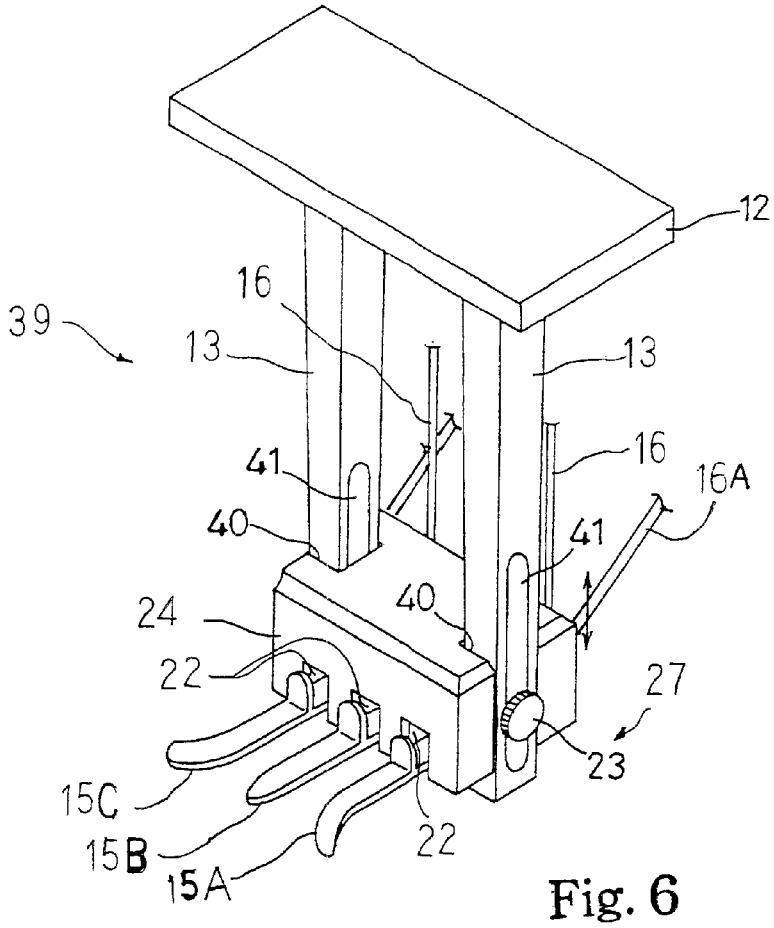
FIG. 6 is a perspective view showing the structure of a pedal system incorporated in another grand piano according to the present invention.

Turning to FIG. 6 of the drawings, a pedal system 39 is incorporated in a grand piano embodying the present invention. The grand piano implementing the second embodiment is similar in structure to the grand piano except the pedal system 39. For this reason, description is focused on the pedal system 39.

The pedal system 39 includes the lyre block 12, the pedal posts 13, a lyre box 24, the three pedals 15A/15B/15C, the pedal rods 16 and a coupler 27. The lyre block 12, pedal posts 13, three pedals 15A/15B/15C and pedal rods 16 are same as those of the pedal system 10. For this reason, description on these component parts is omitted for the sake of simplicity.

The lyre box 24 has a generally rectangular parallelepiped configuration, and the upper/lower panels, side panels and front/rear panels define an inner space as similar to the lyre box 14. The three pairs of through-holes 22 are formed in the front and rear panels, and the pedals 15A/15B/15C project from the lyre box 24 through the three pairs of through-holes 22. However, the through-holes 21 are not formed in the upper and lower panels. Instead, guide grooves 40 are formed. The side panels are indented so as to form grooves 40, and the grooves 40 vertically extend. The threaded holes 25 are formed in the bottoms of the grooves 40. The grooves 40 have respective cross sections similar to the cross sections of the pedal posts 13, and the pedal posts 13 are received in the grooves 40, respectively. The lyre box 24 is slidable along the pedal posts 13.

The pedal posts 13 are respectively formed with elongated holes 41. The elongated holes 41 are long enough to take up the difference between adult players and child players. The stem portions of the bolts 23 pass through the elongated holes 41, and are screwed into the threaded holes 25.

When the pianist is changed from an adult person to a child, the nuts 33 are also spaced from the rear portions 5*a* of the pedals 15A/15B/15C, and the bolts 23 are loosened. The pedal posts 13 are released from the lyre box 24, and the lyre box 24 is moved to an appropriate position. The bolts 23 are screwed into the threaded holes 25, and the knobs are pressed against the pedal posts 13. The pedal posts 13 in turn are pressed against the bottom surfaces of the lyre box 24, and the lyre box 24 is secured to the pedal posts 13.

As will be understood, the lyre box 24 is slidable along the pedal posts 13, and is secured to the pedal posts 13 by means of the coupler 27, i.e., the bolts 23 and threaded screws 25. Thus, the pedals 15A/15B/15C are positioned at any positions suitable to a player. Any assistant pedal system is not required for the grand piano, and the classical external appearance is maintained in the grand piano implementing the second embodiment.

The lyre box 24 serves as a foundation, and the pedal rods 16 are corresponding to plural connectors. The pedal posts 13 and the side panels formed with the guide grooves 40 as a whole constitute a mechanism.

Third Embodiment

Figure 7:
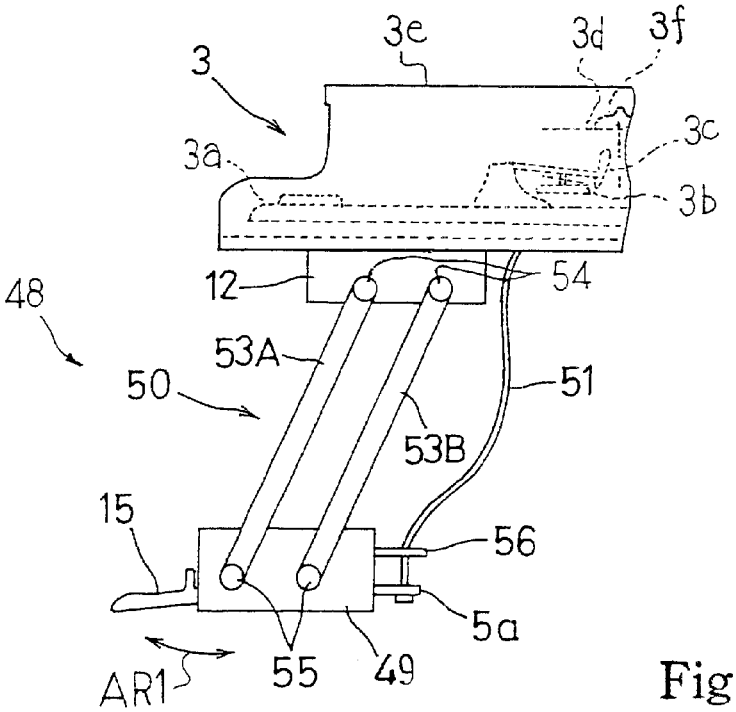
FIG. 7 is a side view snowing the structure of a pedal system incorporated in yet another grand piano according to the present invention.

FIG. 7 shows a pedal system 48 incorporated in yet another grand piano 3 embodying the present invention. A keyboard 3*a,* an action mechanism 3*b,* hammers 3*c,* dampers 3*f* and strings 3*d* are accommodated in a piano case 3*e.* When a fallboard, which forms a part of the piano case 3*e,* is raised, the keyboard 3*a* is exposed to a pianist. The action mechanism 3*b,* hammers 3*c* and strings 3*d* are well known to skilled persons, and no further description is incorporated hereinbelow.

The pedal system 48 includes the lyre block 12, a lyre box 49, the three pedals 15, a link mechanism 50 and flexible pedal wires 51. The lyre block 12 and the three pedals 15 are similar to those of the grand piano implementing the first embodiment, and description is focused on the other component parts.

The lyre box 49 has a rectangular parallelepiped configuration, and the upper/lower panels, front/rear panels and side panels define an inner space where the three pedals 15 are rotatably supported. The through-holes 21 and the threaded holes 25 are not formed in the upper/lower panels and side panels. Instead, two pairs of threaded holes are formed in the side panels, respectively.

Two pairs of links 53A and 53B are connected in parallel between the side surfaces of the lyre block 12 and the side panels of the lyre box 49. The links 53A/53B have respective upper end portions rotatably connected to the lyre block 12 by means of bolts 54 and respective lower end portions rotatably connected to the lyre box 49 by means of bolts 55. The bolts 54 are spaced from each other by a certain length, and the other bolts 55 are also spaced from each other by the certain length. The links 53A are equal in length to the associated links 53B, respectively. The links 53A and 53B form a parallel link mechanism together with the side surface of the lyre block 12 and the side panel of the lyre box 49. When a user loosens the blots 54/55, the lyre box 49 are angularly movable with respect to the link mechanism 50.

The flexible wires are connected between the rear portions 5*a* of the pedals 15 and the dampers/keyboard. Reference numeral 56 designates a guide plate formed with holes. The flexible wires 51 pass through the holes, and are secured to the rear portions 5*a.*

When a user wants to change the pedal positions, he or she loosens the bolts 54 and 55, and pulls or pushes the lyre box 49. The parallel link mechanism permits the lyre box 49 to move as indicated by arrow ARI. The flexible wires 51 are deformed. When he or she finds a suitable position, he or she screws the bolts 54/55 into the threaded holes, and secures the links 53A/53B into the lyre block 12 and the lyre box 49. The knobs are pressed against the links 53A/53B, and the links 53A/53B in turn are pressed against the side surfaces of the lyre block 12 and the side panels of he lyre box 49. Thus, the links 53A/53B are secured to the lyre block 12, and the lyre box 49 is secured to the links 53A/53B.

The link mechanism 50 and the bolts 54/55 are not conspicuous, and the classical appearance is maintained in the grand piano 3. The coupler, i.e., the bolts 54/55 and associated threaded holes keep the lyre box 49 at the suitable position. This means that the pianists can changes the pedals 15 to any suitable positions.

Moreover, the link mechanism 50 and the flexible wires 51 allow the pianist to change the pedals 15 in the fore-and-aft direction as well as in the vertical direction. Thus, the pianist locates the pedals 15 at the optimum position in the wide zone by virtue of the link mechanism 50 and the flexible wires 51.

Finally, the flexible wires 51 makes the regulating work simpler than that of the above-described embodiment, because the user does not need to change the connection to the rear portions 5*a.*

In the third embodiment, the strings 3*d* serves as beaten members, and the action mechanism 3*b,* the hammers 3*c* and the dampers 3*f* form in combination an inner mechanism. The side surfaces of the lyre block 12, the links 53A/53B, the bolts 54/55 and the side panels as a whole constitute a mechanism.

Fourth Embodiment

Figure 8:
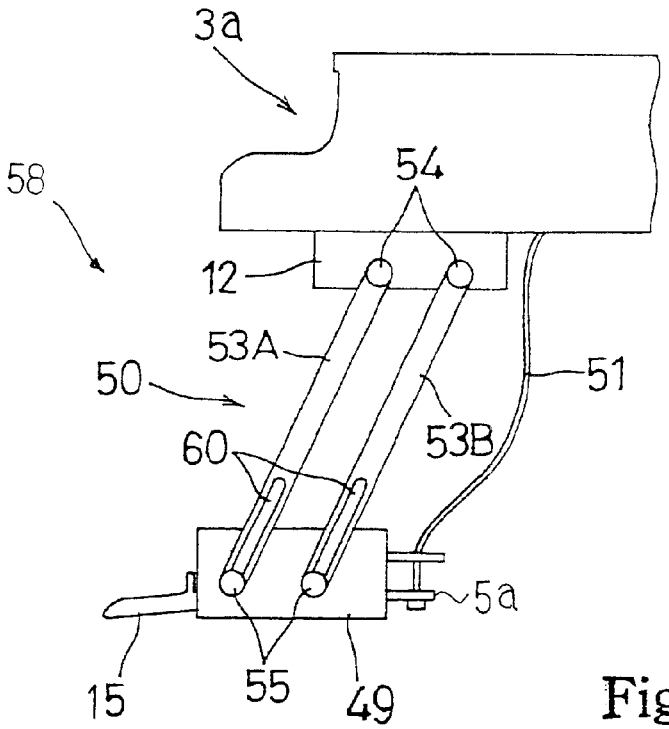
FIG. 8 is a side view showing the structure of a pedal system incorporated in still another grand piano according to the present invention.

FIG. 8 shows a pedal system 58 incorporated in still another grand piano embodying the present invention. The pedal system 58 is similar to the pedal system 48 except elongated holes 60 formed in the links 5A/53B. For this reason, the component parts of the pedal system 58 are labeled with the same references designating corresponding parts of the pedal system 48.

The threaded stems of the bolts 55 pass through the elongated holes 60, and are screwed into the threaded holes formed in the side panels of the lyre box 49. When a user loosens only the blots 55, the user moves the lyre box 49 in parallel, and inclines the lyre box 49 toward the lyre block 12. Of course, when all the bolts 54/55 are loosened, the lyre box 49 becomes swingable as similar to that of the pedal system 48. Thus, the elongated holes 60 enhance the flexibility in the regulating work.

Fifth Embodiment

Figure 9:
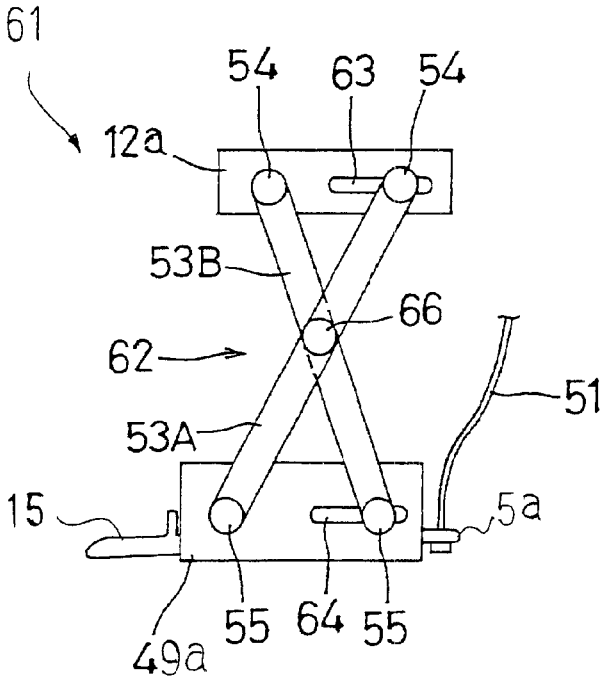
FIG. 9 is a side view showing the structure of a pedal system incorporated in yet another grand piano according to the present invention.

Turning to FIG. 9 of the drawings, a pedal system 61 is incorporated in still another grand piano embodying the present invention. The pedal system 61 includes a lyre block 12*a,* a lyre box 49*a,* the three pedals 15, the flexible wires 51 and a link mechanism 62. The three pedals 15 and flexible wires 51 are similar to those of the third embodiment, and are not described in detail hereinbelow.

The lyre block 12*a* is also fixed to the lower surface of the key bed (not shown), and is formed with guide slots 63. The guide slots 63 are laterally elongated. The guide slots 63 are open on the side surfaces of the lyre block 12*a.* Guide slots 64 are also formed in the side panels of the lyre box 49*a,* and are also laterally elongated. Two pairs of links 53A/53B and center bolts 66 form in combination the link mechanism together with the blots 54/55. The links 53A cross the associated links 53B, respectively, and are connected to the links 53B by means of the center bolts 66. The center bolts 66 set the links 53A/53B to a given angle. However, when the center bolts are loosened, the center bolts allow the links 53A and 53B to vary the angle therebetween. The links 53A are rotatably connected at the lower end portions thereof to the side panels by means of the bolts 55, respectively, and the other links 55B are also rotatably connected at the upper end portions thereof to the side surfaces of the lyre block 12*a* by means of the bolts 54, respectively. On the other hand, the upper end portions of the links 53A are rotatably supported by the bolts 54, and the bolts 54 are movable along the guide slots 63. Though not shown in the drawings, stop rings are engaged with the threaded stem portions of the bolts 54 in the guide slots 63, and prohibit the blots 54 from dropping from the slots 63. Similarly, the lower end portions of the links 53B are rotatably supported by the bolts 55, and the bolts 55 are movable along the guide slots 64. Stop rings are also engaged with the stem portions, and prohibit the bolts 55 from dropping from the slots 63.

When a user wants to change the positions of the pedals 15, he or she loosens the center bolts 66, and lifts up or pushes down the lyre box 49*a*. The bolts 54/55 are moved in the guide slots 63/64, and permits the links 53A and 53B to change the angle therebetween. When the user finds the pedals 15 to be at the suitable positions, he or she screws the center bolts 66 into the links 53A/53B, and secures the links 53A to the links 53B. The links 53A and 53B can not change the angle therebetween, and the keep the lyre box 49*a* at the position.

The pedal system 61 achieves all the advantages of the third embodiment. The user fixes the lyre box 49*a* to the suitable position by means of the center bolts 66. The regulating work is easier than that for the third embodiment.

Sixth Embodiment

Figure 1:
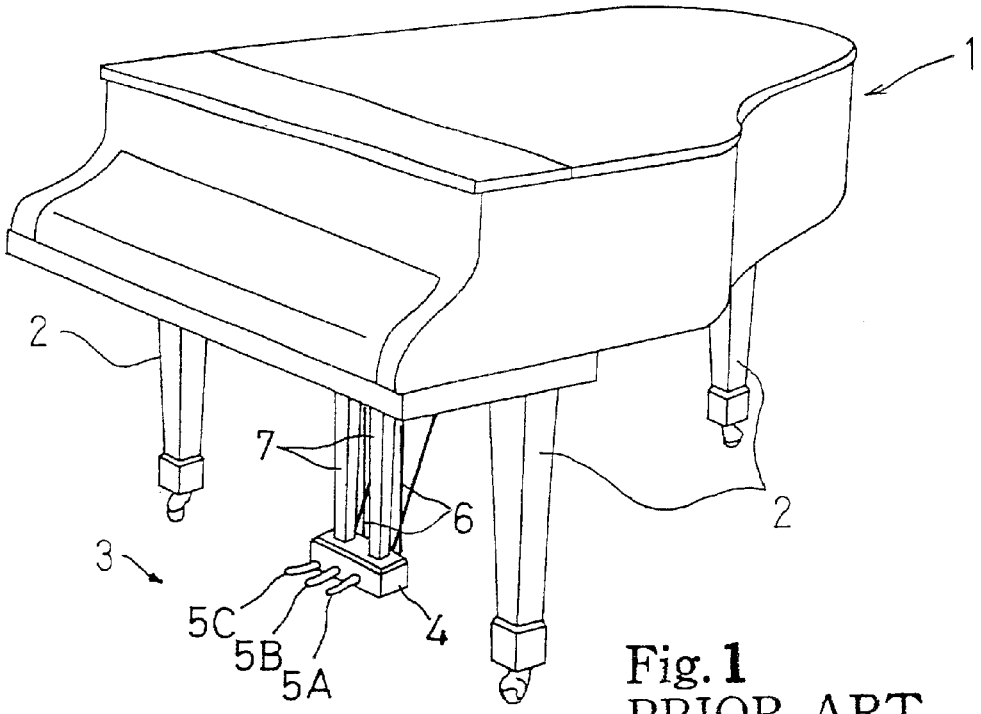
Fig. 1 PRIOR ART
FIG. 1 is a perspective view showing the external appearance of the prior art grand piano.
Figure 10:
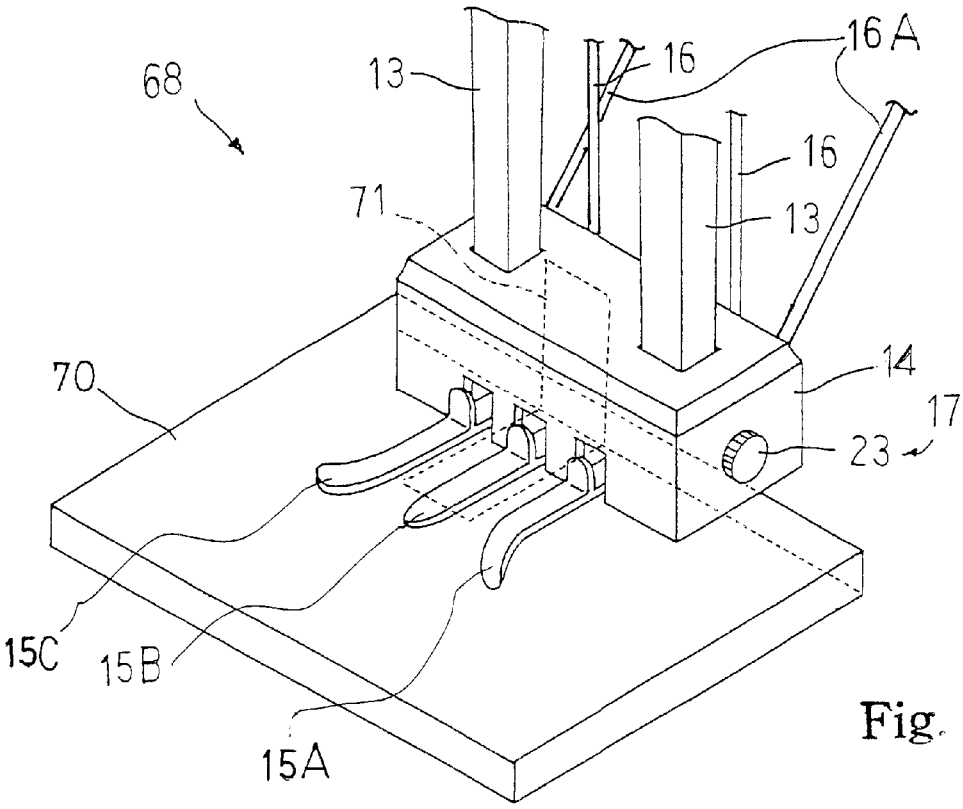
FIG. 10 is a perspective view showing the structure of a pedal system incorporated in still another grand piano according to the present invention.

FIG. 10 shows a pedal system 68 incorporated in yet another grand piano embodying the present invention. The pedal system 68 is similar to the pedal system 10 except a footrest 70 connected to the lyre box 14 by means of an L-letter shaped metal plate 71. When the lyre box 14 is moved upwardly or downwardly, the footrest 70 is moved together with the lyre box 14. A child pianist can rest his or her feet on the footrest 70.

Although particular embodiments of the present invention have been shown and described, it will be apparent to those skilled in the art that various changes and modifications may be made without departing from the spirit and scope of the present invention.

The lyre box may be hung from the lyre block by means of a single pedal post. In this instance, only one pair of through-holes is formed in the upper and lower panels of the lyre box, and the lyre box is slidable along the single pedal post.

The footrest 70 may be connected to the lyre boxes implementing the second to fifth embodiments.

Each of the pedal systems 10/39/48/58/61/68 may have only two pedals, i.e., the damper pedal and soft pedal. In this instance, the muffler pedal and associated pedal rod are deleted from the pedal system, and only two pairs of through-holes 22 are formed in the lyre box.

Figure 11:
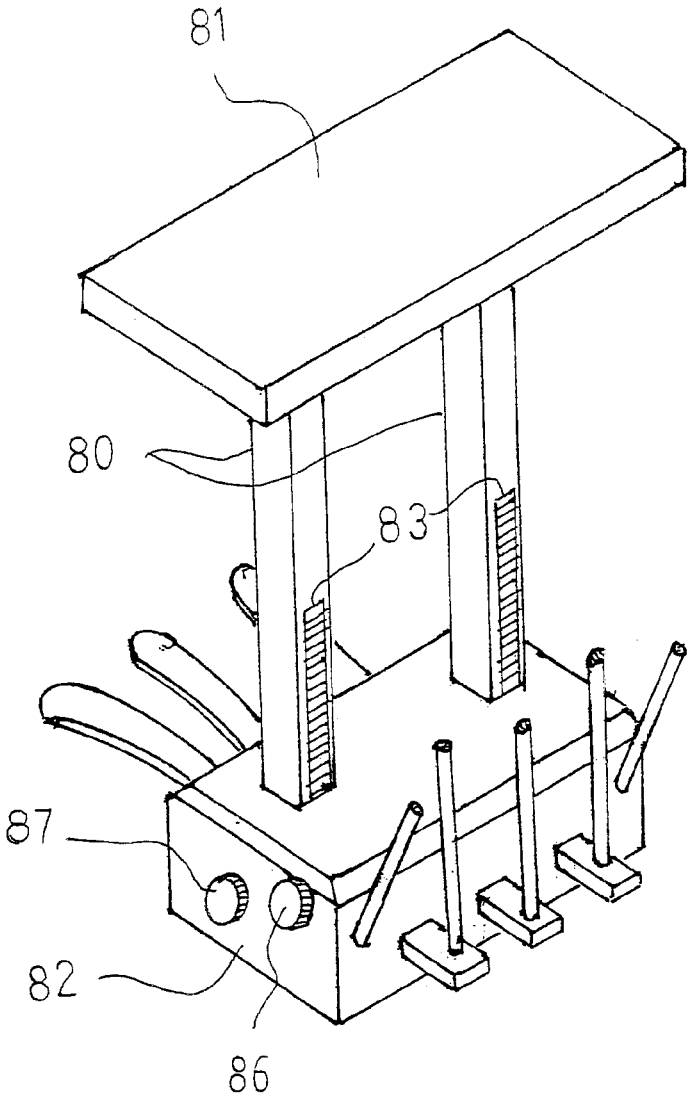
FIG. 11 is a perspective view showing the structure of another pedal system according to the present invention.
Figure 12:
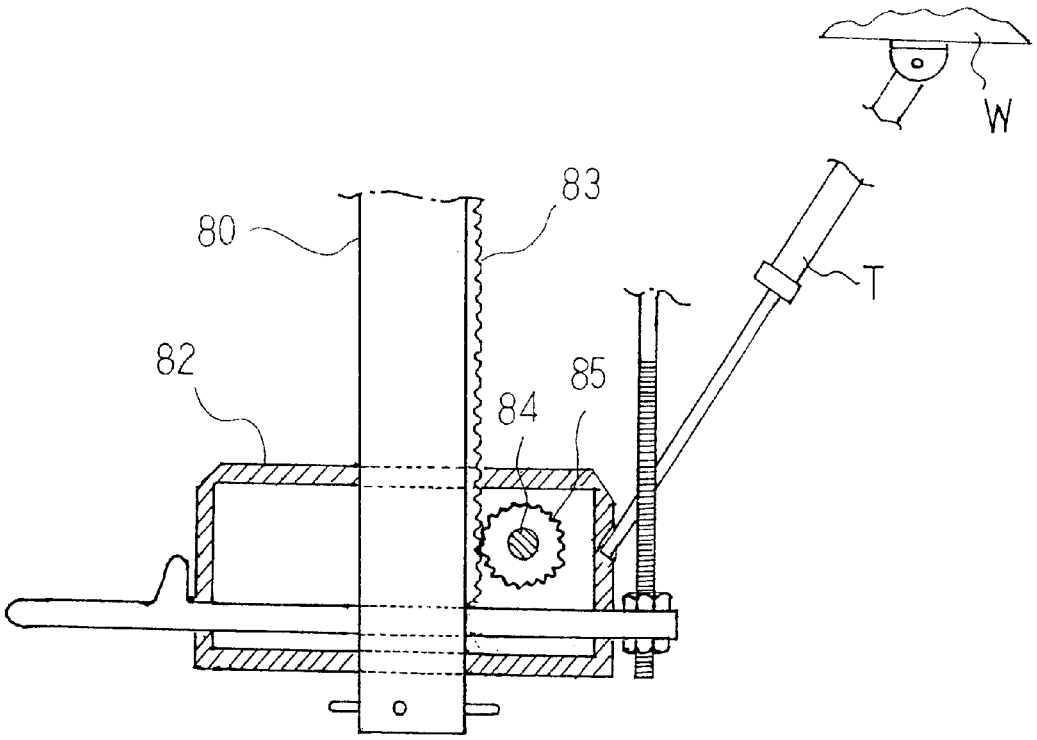
FIG. 12 is a cross sectional view showing the structure of the pedal system.
Figure 13:
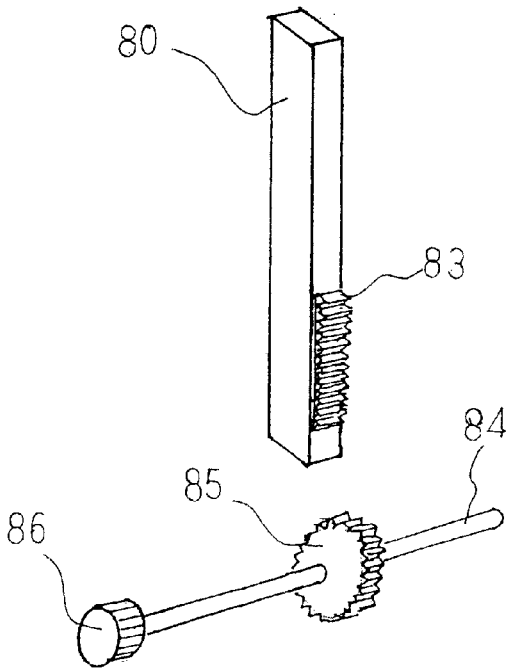
FIG. 13 is a fragmentary perspective view showing a pinion and rack incorporated in the pedal system.

FIGS. 11, 12 and 13 show a pedal system employable in a grand piano according to the present invention. A pair of lyre posts 80 are hung from a lyre block 81, and a lyre box 82 is movably connected to the pair of lyre posts 80. A pair of racks 83 is fixed to the back surfaces of the lyre posts 80. A shaft 84 is rotatably supported by the lyre box 82, and a pair of pinions 85 are fixed to the shaft 84. The pinions 85 are spaced from each other by the distance equal to the distance between the racks 83, and are meshed with the associated racks 83, respectively. The shaft 84 sideward projects from the lyre box 82, and a knob 86 is fixed to the projecting portion of the shaft 84. A pair of positioning screws 87 sideward projects from the lyre box 82, and the leading ends are spaced from and pressed to the lyre posts 80. The pedal rods and the lyre brace are regulable as similar to those of the first embodiment. In this instance, the lyre brace is implemented by a pair of telescopic tubes T. The telescopic tubes T are hinged at the upper ends thereof to the lower surface of the key bed W, and are inserted at the lower ends thereto into recesses formed in the lyre box 82.

When a pianist wishes to change the lyre box 82 from the current position to another, he or she firstly loosens the positioning screws 87 so as to make the lyre box 82 movable along the lyre posts 80. Subsequently, he or she rotates the knob 86, and the knob 86 gives rise to the rotation of the shaft 84 and, accordingly, the pinions 85. The racks 83 converts the rotation of the pinions 85 to straight motion, and the lyre box 82 are moved along the lyre posts 80 upwardly or downwardly depending upon the rotational direction of the knob 86. When the lyre box 82 reaches the position proper to him or her, he or she rotates the positioning screws 87, and presses the leading ends to the side surfaces of the lyre posts 80. The positioning screws keep the lyre box 82 at the proper position.

Figure 14:
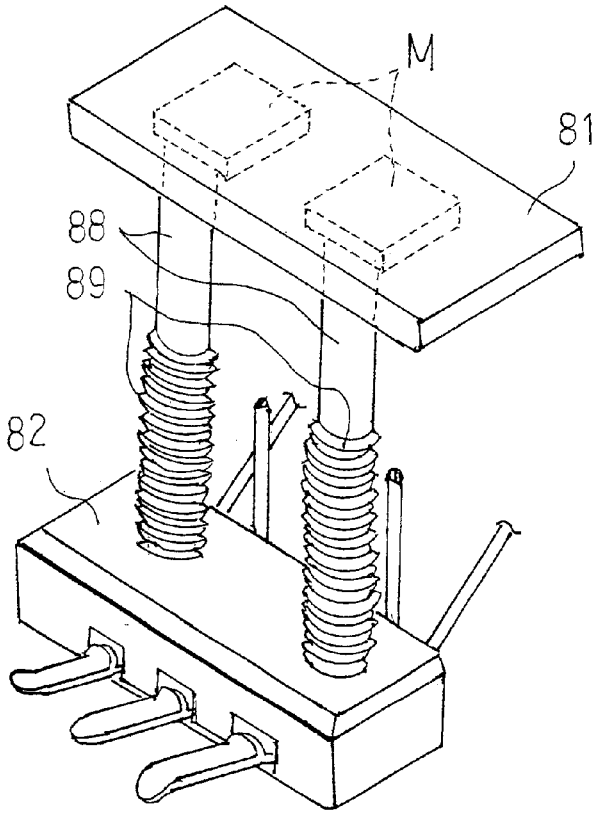
FIG. 14 is a perspective view showing the structure of yet another pedal system according to the present invention.
Figure 15:
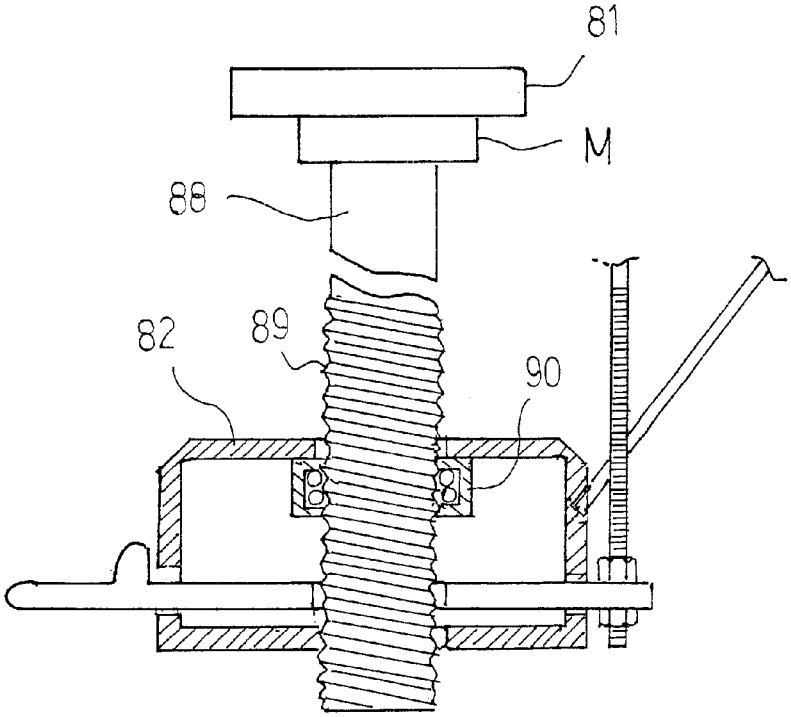
FIG. 15 is a cross sectional view showing the structure of the pedal system.

Yet another pedal system according to the present invention is shown in FIGS. 14 and 15. The lyre box 82 is also movably connected to a pair of lyre posts 88, which is fixed to the output shafts of electric motors M. The electric motors M are fixed to the lower surface of the lyre block 81. Male screws 89 are formed in the surface portions of the lyre posts 88, and a pair of ball threads 90 are fixed to the inner surface of the lyre box 82. The male screws 89 are meshed with the ball threads 90, and the electric motors M are connected to a suitable driving circuit. The pedal rods are regulable as similar to those of the first embodiment.

When a pianist wishes to change the lyre box 82 to a proper position, he or she energizes the electric motors M. The output shafts of the electric motors M are driven for rotation, and, accordingly, the male screws 89 are rotated. The ball threads 90 changes the rotation of the male screws 89 to straight motion of the lyre box 82. Lyre box 82 is moved upwardly or downwardly depending upon the rotational direction of the output shaft. When the lyre box 82 reaches the proper position, he or she stops the electric power, and the electric motors M keep the lyre box 82 at the proper position.

Figure 16:
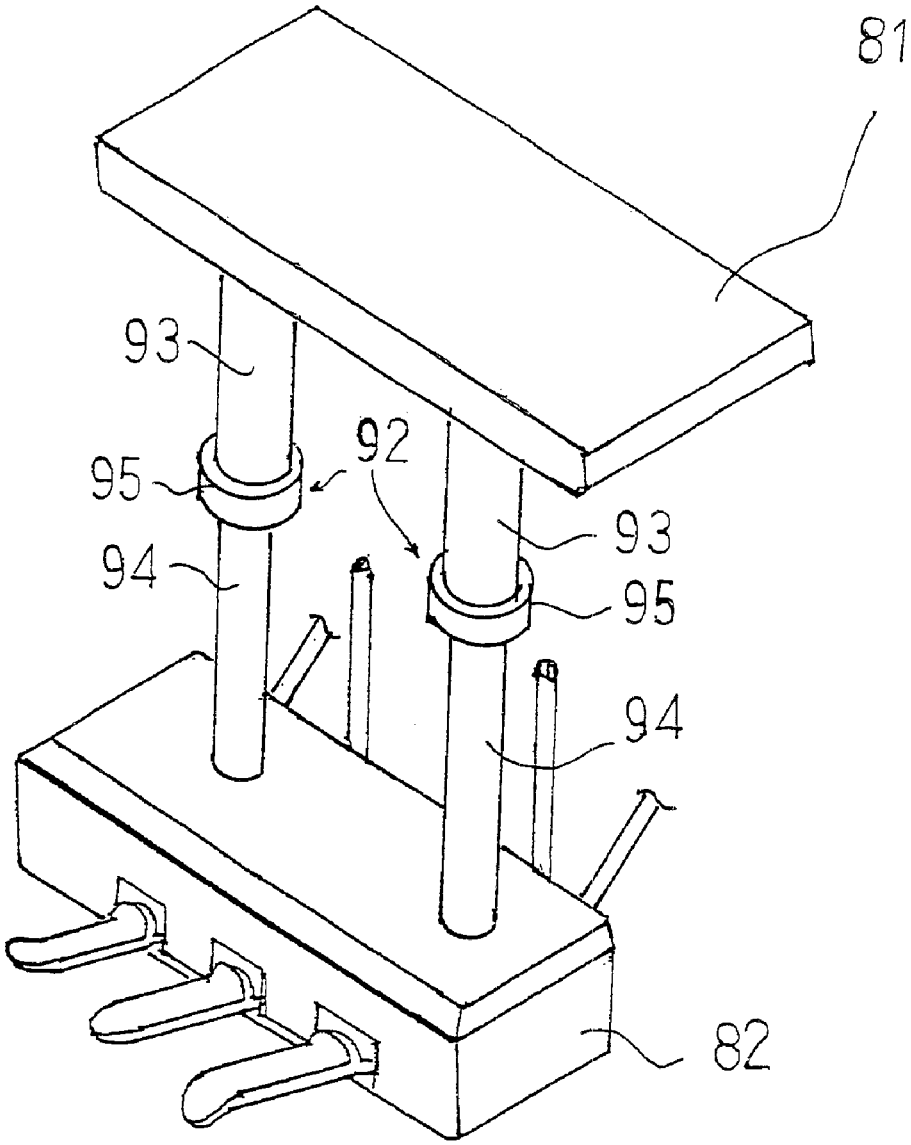
FIG. 16 is a perspective view showing the structure of still another pedal system according to the present invention.

Still another pedal system is shown in FIG. 16. A pair of telescopic posts 92 are hung from the lyre block 81, and the lyre box 82 is fixed to the lower ends of the telescopic posts 92. The telescopic posts 92 have respective relatively thick tubular members 93, relatively thin shaft members 94 and fasteners 95. The shaft members 94 are slidably inserted into the tubular members 93, respectively, and are loosened from or secured to the tubular members 93 by means of the fasteners 95, respectively. The upper ends of the tubular members 93 are fixed to the lyre block 81, and the lower ends of the shaft members 94 are fixed to the upper surface of the lyre box 82. The pedal rods are regulable as similar to those of the first embodiment.

When a pianist wishes to change the lyre box 82 to a proper position, he or she loosens the fasteners 95, and makes the shaft members 94 slidable. He or she lifts up the lyre box or pulls down it. The shaft members 94 are retracted into or project from the tubular members 93. When the lyre box 82 reaches the proper position, he or she secures the shaft members 94 to the tubular members 93 by means of the fasteners 95.

The present invention may be applied to a pedal system incorporated in an upright piano. The pedal system according to the present invention is also applicable to a composite keyboard musical instrument fabricated on the basis of an acoustic piano. A typical example of the composite keyboard musical instrument is called as a silent piano, and another example is an automatic player piano. A keyboard for practical use is yet another example of the composite keyboard musical instrument.

The silent piano is a combination of an acoustic piano, i.e., a grand piano or upright piano and an electronic tone generating system, and a pianist can play a piece of music in acoustic tones or electronic tones. In order to permit the pianist to play a piece of music in the electronic tones, the silent piano is equipped with a hammer stopper and an electronic sound generating system. The hammer stopper is provided in association with the hammers, and is changed between a free position and a blocking position. While the hammer stopper is maintained at the free position, the hammers strike the associated sets of strings without any interruption by the hammer stopper. When the hammer stopper is changed to the blocking position, the hammer stopper enters into the trajectories of the hammers, and the hammers rebound on the hammer stopper before striking the strings. The electronic sound generating system produces electronic sounds instead of the piano tones so that user can practice the fingering without disturbance to the neighborhood.

The automatic player piano is a combination of an acoustic piano and an automatic playing system. The acoustic piano is either grand or upright. The automatic playing system includes solenoid-operated key actuators installed under the keyboard and a controller. When a set of music data codes is supplied to the controller, the controller analyzes the set of music data codes, and selects the keys to be moved from the keyboard and times at which the keys start the motion. When the time comes, the controller supplies a driving signal to the solenoid-operated key actuator under the key to be moved. The solenoid-operated key actuator moves the key at the give time, and the key actuates the action unit so as to give rise to free rotation of the hammer toward the string.

The keyboard for practical use is a modification of the acoustic piano. The hammer assemblies and strings are replaced with beaters and an impact absorber. While a trainee is fingering a piece of music on the keyboard, the depressed keys actuate the associated action units, which in turn give rise to free rotation of the hammers through the escape. The beaters rebound on the impact absorber, and the piano tones are not generated. An electronic tone generating system may be further incorporated in the keyboard for practical use. In this instance, sensors monitor the beaters, and periodically report the current positions of the beaters. The controller analyzes the series of positional data information so as to specify the depressed keys. The controller produces music data codes representative of the fingering on the keyboard, and supplies them to a tone generator. The tone generator produces an audio signal from the music data codes, and a sound system converts the audio signal to the electronic tones. Thus, the trainee checks the fingering for his training through the electronic tones.

What is claimed is:

1. A keyboard musical instrument comprising a case having an inner space, a keyboard mounted on a flat board of said case and exposed to a player, an internal mechanism including an action mechanism linked with said keyboard and actuated when said player depresses keys of said keyboard, hammers associated with said keys, respectively, and driven for rotation by said action mechanism when said player depresses the associated keys and beaten members provided in association with said hammers and struck with said hammers at the end of said rotation, a damper mechanism linked with said keyboard and driven by said keys so as to influence vibrations of said beaten members, and a pedal mechanism including plural pedals depressed by said player for changing attributes of tones to be generated when said keys are depressed, a foundation on which said plural pedals are rotatably supported, plural connectors connected between said plural pedals and said internal mechanism for transmitting motion of said pedals to said internal mechanism, a mechanism provided between said case and said foundation and permit said foundation to move with respect to said case and a coupler provided for said foundation and changed between a releasing position for permitting said foundation to move with respect to said case and a fixing position for prohibiting said foundation from changing the position thereof with respect to said case.

2. The keyboard musical instrument as set forth in claim 1, in which said case has an external appearance of a piano case of an acoustic piano, and said keyboard, said internal mechanism and said beaten members are corresponding to a keyboard, a combination of an action mechanism, dampers and hammers and strings of said acoustic piano, respectively.

3. The keyboard musical instrument as set forth in claim 2, in which said acoustic piano is a grand piano.

4. The keyboard musical instrument as set forth in claim 1, in which said case, said keyboard, said internal mechanism and said beaten members are corresponding to a piano case, a keyboard, a combination of an action mechanism, dampers and hammers and strings of a grand piano, respectively, and said foundation and said mechanism are corresponding to a lyre box and a combination of at least one pedal post and a guide surface formed in said lyre box of said grand piano, respectively.

5. The keyboard musical instrument as set forth in claim 4, in which said guide surface is peripheral surfaces of upper and lower panels of said lyre box defining at least one pair of through holes through which said at least one pedal post extends.

6. The keyboard musical instrument as set forth in claim 5, in which at least one threaded hole is formed in a side panel of said lyre box, and said at least one threaded hole serves as said coupler together with a bolt screwed into said at lest one threaded hole for pressing said at lest one pedal post to said peripheral surfaces.

7. The keyboard musical instrument as set forth in claim 4, in which said lyre box has a certain range to move along said at least one pedal post, said connectors are corresponding to pedal rods formed with threaded surfaces not shorter than said certain range so that said pedals are moved along said threaded surfaces of said pedal rods during said lyre box is moved along said at least one pedal post, nuts are engaged with said threaded surfaces for sandwiching said plural pedals at certain positions on the threaded surfaces.

8. The keyboard musical instrument as set forth in claim 1, in which said case, said keyboard, said internal mechanism and said beaten members are corresponding to a piano case, a keyboard, a combination of an action mechanism, dampers and hammers and strings of a grand piano, respectively, and said foundation and said mechanism are corresponding to a lyre box and a combination of a pair of pedal posts and guide surfaces formed in said lyre box of said grand piano, respectively.

9. The keyboard musical instrument as set forth in claim 8, in which said guide surfaces are side surfaces of said lyre box defining guide grooves in which said pedal posts of said pair are received, and said coupler includes threaded holes formed in said lyre box and exposed to bottoms of said guide grooves, elongated holes formed in said pedal posts and bolts passing through said elongated holes and engaged with said threaded holes.

10. The keyboard musical instrument as set forth in claim 1, in which said case, said keyboard, said internal mechanism and said beaten members are corresponding to a piano case, a keyboard, a combination of an action mechanism, dampers and hammers and strings of a grand piano, respectively, and said foundation and said mechanism are corresponding to a lyre box and a link mechanism connected between said lyre box and a stationary board fixed to a lower surface of said case, respectively.

11. The keyboard musical instrument as set forth in claim 10, in which said link mechanism includes side surfaces of said stationary board, side surface of said lyre box and two pairs of links movably connected at first ends thereof to said side surfaces of said stationary board and at second ends thereof to said side surfaces of said lyre box in such a manner that the links of each pair are arranged in parallel, and said coupler includes threaded holes formed in said side surfaces and bolts passing through said links and screwed into said threaded holes so as to press said links against said side surfaces.

12. The keyboard musical instrument as set forth in claim 11, in which said links are formed with elongated slots, and said bolts are screwed through said elongated slots into said threaded holes formed in said side surfaces of said lyre box so that said lyre box is movable along said elongated slots.

13. The keyboard musical instrument as set forth in claim 10, in which said link mechanism includes two pairs of links crossing one another and connecting members rotatably connecting first ends of said links to side surfaces of said lyre box and other connecting members rotatably connecting second ends of said links to side surfaces of a stationary board fixed to a lower surface of said case, guide slots formed in side portions of said stationary board for movably receiving the connecting members and guide slots formed in side portions of said lyre box for movably receiving the other connecting members so that the links of each pair are permitted to changed an angle therebetween, and said coupler includes threaded holes formed in central portions of said links and bolts engaged with said threaded holes so as to press said central portions against each other.

14. The keyboard musical instrument as set forth in claim 10, in which said plural connectors are flexible so as to take up variance of said lyre box due to the motion of said link mechanism.

15. The keyboard musical instrument as set forth in claim 1, in which said case, said keyboard, said internal mechanism and said beaten members are corresponding to a piano case, a keyboard, a combination of an action mechanism, dampers and hammers and strings of a grand piano, respectively, and said foundation is corresponding to a lyre box from which a footrest is hung.

16. The keyboard musical instrument as set forth in claim 15, in which said lyre box is further connected to said case by means of a lyre brace variable in length.

17. A grand piano comprising a piano case having plural boards defining an inner space, a keyboard mounted on one of said plural boards, an action mechanism accommodated in said inner space and linked with said keyboard, hammers connected to said action mechanism and selectively driven for rotation by said action mechanism, strings stretched over said hammers and struck with the hammers at the end of said rotation for generating tones, a damper mechanism linked with said keyboard, spaced from and held in contact with said strings for temporarily permitting the strings to vibrate, and a pedal mechanism including a lyre block fixed to a lower surface of said one of said plural boards, at least one pedal post hung from said lyre block, a lyre box engaged with said at least one pedal post and slidably therealong, plural pedals movably supported by said lyre box and selectively moved by a player so as to prolong the tones and lessen the volume of said tones, plural pedal rods connected at first ends thereof to said plural pedals and at second ends thereof to said damper mechanism and said keyboard for relaying the motion of said plural pedals to said damper mechanism and said keyboard, and a coupler provided between said lyre box and said pedal post for securing said lyre box to said pedal post at a position selected by said player.

18. A grand piano comprising a piano case having plural boards defining an inner space, a keyboard mounted on one of said plural boards, an action mechanism accommodated in said inner space and linked with said keyboard, hammers connected to said action mechanism and selectively driven for rotation by said action mechanism, strings stretched over said hammers and struck with the hammers at the end of said rotation for generating tones, a damper mechanism linked with said keyboard, spaced from and held in contact with said strings for temporarily permitting the strings to vibrate, and a pedal mechanism including a lyre block fixed to a lower surface of said one of said plural boards, a lyre box spaced from said lyre block, plural pedals movably supported by said lyre box and selectively moved by a player so as to prolong the tones and lessen the volume of said tones, plural flexible connectors connected at first ends thereof to said plural pedals and at second ends thereof to said damper mechanism and said keyboard for relaying the motion of said plural pedals to said damper mechanism and said keyboard, a link mechanism connected at one end thereof to said lyre block and at the other end thereof to said lyre box for changing the distance between said lyre block and said lyre box, and a coupler provided between said lyre block and said link mechanism and between said link mechanism and said lyre box for keeping said lyre box at a position selected by said player.

19. A grand piano comprising a piano case having plural boards defining an inner space, a keyboard mounted on one of said plural boards, an action mechanism accommodated in said inner space and linked with said keyboard, hammers connected to said action mechanism and selectively driven for rotation by said action mechanism, strings stretched over said hammers and struck with the hammers at the end of said rotation for generating tones, a damper mechanism linked with said keyboard, spaced from and held in contact with said strings for temporarily permitting the strings to vibrate, and a pedal mechanism including a lyre block fixed to a lower surface of said one of said plural boards, a lyre box spaced from said lyre block, plural pedals movably supported by said lyre box and selectively moved by a player so as to prolong the tones and lessen the volume of said tones, plural flexible connectors connected at first ends thereof to said plural pedals and at second ends thereof to said damper mechanism and said keyboard for relaying the motion of said plural pedals to said damper mechanism and said keyboard, a link mechanism connected at one end thereof to said lyre box and at the other end thereof to said lyre box for changing the distance between said lyre block and said lyre box, and a coupler connected to said link mechanism, allowing said link mechanism to move for changing said lyre box from a position to another position and prohibiting said link mechanism for keeping said lyre box at a position selected by said player.

* * * * *